US006184833B1

(12) United States Patent
Tran

(10) Patent No.: US 6,184,833 B1
(45) Date of Patent: Feb. 6, 2001

(54) DUAL STRIP ANTENNA

(75) Inventor: Allen Minh-Triet Tran, San Diego, CA (US)

(73) Assignee: Qualcomm, Inc., San Diego, CA (US)

( * ) Notice: Under 35 U.S.C. 154(b), the term of this patent shall be extended for 0 days.

(21) Appl. No.: 09/090,478

(22) Filed: Jun. 4, 1998

Related U.S. Application Data

(60) Provisional application No. 60/075,781, filed on Feb. 23, 1998.

(51) Int. Cl.[7] ..... H01Q 1/24; H01Q 1/38

(52) U.S. Cl. ..... 343/700 MS; 343/702

(58) Field of Search ..... 343/700 MS, 702, 343/731; H01Q 1/24, 1/38

(56) References Cited

U.S. PATENT DOCUMENTS

| | | | | |
|---|---|---|---|---|
| 4,700,194 | * | 10/1987 | Ogawa et al. | 343/700 MS |
| 5,365,246 | | 11/1994 | Rasinger et al. | 343/702 |
| 5,394,160 | | 2/1995 | Iwasaki et al. | 343/702 |
| 5,642,120 | | 6/1997 | Fujisawa | 343/702 |
| 5,644,319 | * | 7/1997 | Chen et al. | 343/702 |
| 5,650,790 | | 7/1997 | Fukuchi et al. | 343/702 |
| 5,691,732 | | 11/1997 | Tsuru et al. | 343/745 |
| 5,717,409 | | 2/1998 | Garner et al. | 343/702 |
| 5,801,660 | * | 9/1998 | Ohtsuka et al. | 343/700 MS |
| 5,886,668 | * | 3/1999 | Pedersen et al. | 343/702 |
| 5,898,404 | * | 4/1999 | Jou | 343/702 |

FOREIGN PATENT DOCUMENTS

| | | | |
|---|---|---|---|
| 5589873 | 11/1974 | (AT) | H01Q/13/20 |
| 1960658 | 2/1996 | (DE) | H01Q/1/22 |
| 0177362 | 4/1986 | (EP) | H01Q/1/24 |
| 0246026 | 11/1987 | (EP) | H01Q/1/24 |
| 0332139 | 9/1989 | (EP) | H01Q/1/32 |
| 0450881 | 3/1991 | (EP) | H01Q/9/04 |
| 0806810 | 4/1997 | (EP) | H01Q/9/04 |
| 0777295 | 6/1997 | (EP) | H01Q/9/04 |
| 0818847 | 7/1997 | (EP) | H01Q/9/42 |
| 9102386 | 7/1990 | (WO) | H01Q/1/24 |
| 9101577 | 2/1991 | (WO) | H01Q/1/38 |
| 9844587 | 3/1998 | (WO) | H01Q/9/04 |

* cited by examiner

*Primary Examiner*—Hoanganh Le
(74) *Attorney, Agent, or Firm*—Philip R. Wadsworth; Charles D. Brown; Tom Streeter

(57) ABSTRACT

A dual strip antenna that includes first and second conductive strips, each made from a conductive material. The first and second strips are separated by a dielectric substrate having a predetermined thickness. The first strip is electrically connected to the second strip at one end. A coaxial signal feed is coupled to the dual strip antenna. The dual strip antenna provides an increase in bandwidth over conventional microstrip patch antennas, which is made possible by operating the dual strip antenna as an open-ended parallel plate waveguide having asymmetrical conductor terminations. The operation of the dual strip antenna as an open-ended parallel plate waveguide is achieved by selecting appropriate dimensions for the lengths and widths of the first and second strips. Antenna compactness and a greater variety of useful shapes allow the dual strip antenna to be used as an internal wireless device antenna.

19 Claims, 16 Drawing Sheets

PRIOR ART
FIG. 2
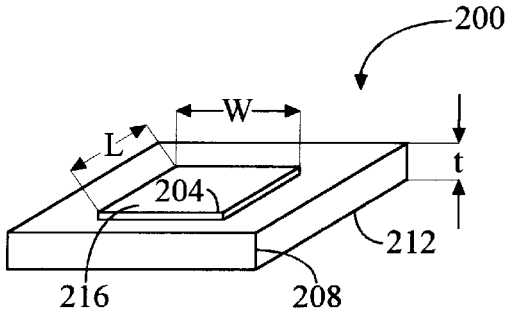
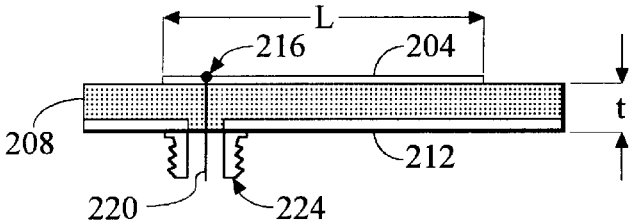
PRIOR ART
FIG. 3
FIG. 4
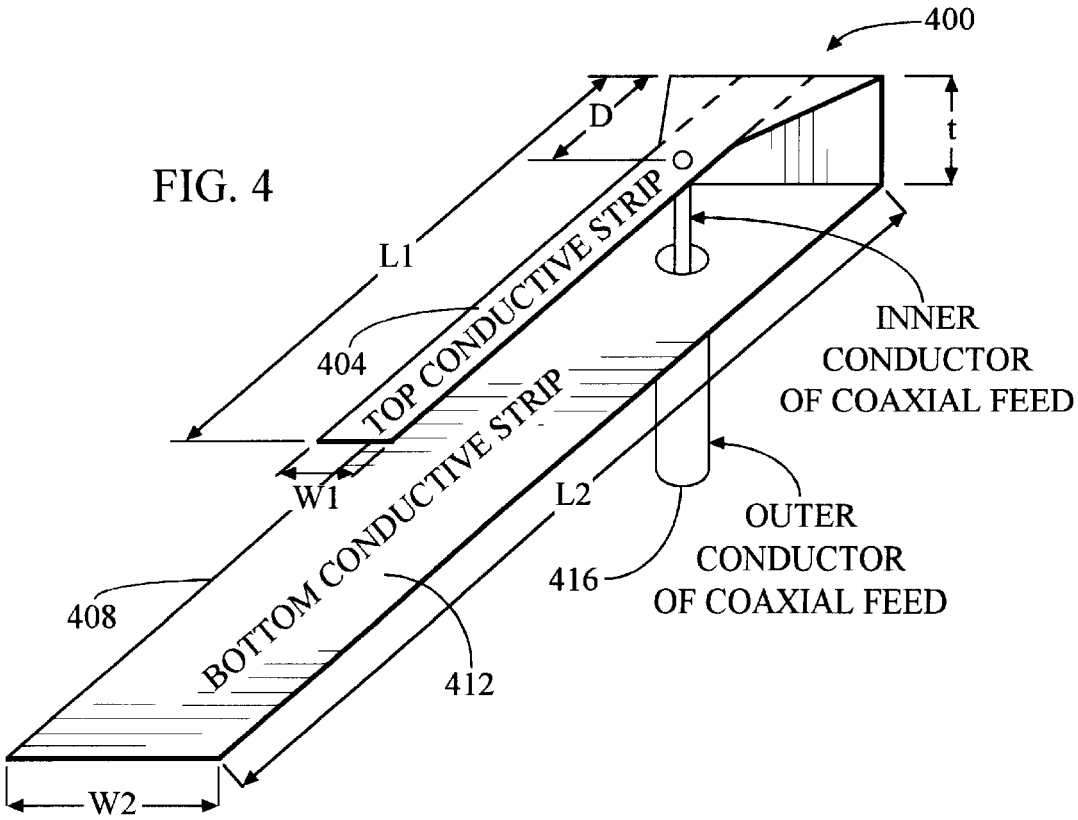

Z=CURVE

V SHAPED IN XY
V SHAPED IN ZX

U SHAPED IN XY
U DIP IN Z

FIG. 15A
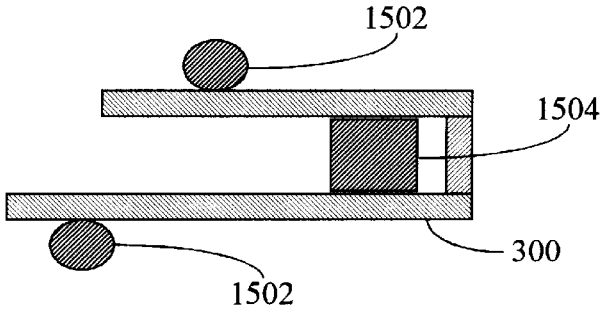
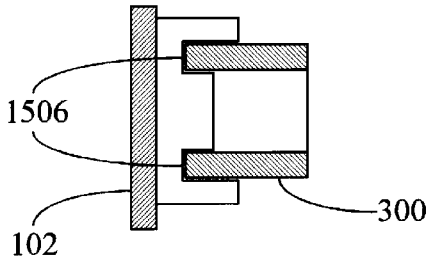
FIG. 15B
FIG. 15C
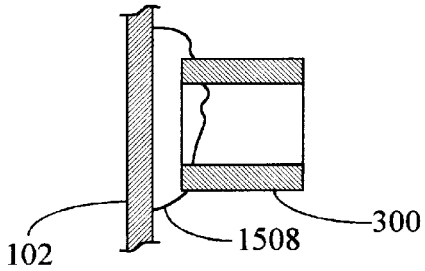
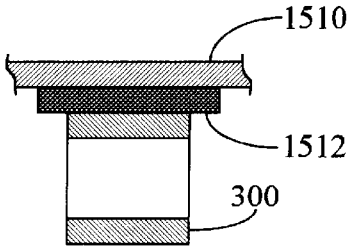
FIG. 15D

DUAL STRIP ANTENNA

This appln claims the benefit of U.S. Provisional Ser. No. 60/075,781 filed Feb. 23, 1998.

BACKGROUND OF THE INVENTION

I. Field of the Invention

The present invention relates generally to antennas, and more particularly, to a dual strip multiple frequency antenna. The invention further relates to internal antennas for wireless devices, especially having improved bandwidth and radiation characteristics.

II. Description of the Related Art

Antennas are an important component of wireless communication devices and systems. Although antennas are available in numerous different shapes and sizes, they each operate according to the same basic electromagnetic principles. An antenna is a structure associated with a region of transition between a guided wave and a free-space wave, or vice versa. As a general principle, a guided wave traveling along a transmission line which opens out will radiate as a free-space wave, also known as an electromagnetic wave.

In recent years, with an increase in use of personal wireless communication devices, such as hand-held and mobile cellular and personal communication services (PCS) phones, the need for suitable small antennas for such communication devices has increased. Recent developments in integrated circuits and battery technology have enabled the size and weight of such communication devices to be reduced drastically over the past several years. One area in which a reduction in size is still desired is communication device antennas. This is due to the fact that the size of the antenna can play an important role in decreasing the size of the device. In addition, the antenna size and shape impacts device aesthetics and manufacturing costs.

One important factor to consider in designing antennas for wireless communication devices is the antenna radiation pattern. In a typical application, the communication device must be able to communicate with another such device or a base station, hub, or satellite which can be located in any number of directions from the device. Consequently, it is essential that the antennas for such wireless communication devices have an approximately omnidirectional radiation pattern.

Another important factor to be considered in designing antennas for wireless communication devices is the antenna's bandwidth. For example, wireless devices such as phones used with PCS communication systems operate over a frequency band of 1.85–1.99 GHz, thus, requiring a useful bandwidth of 7.29 percent. A phone for use with typical cellular communication systems operates over a frequency band of 824–894 MHz, which requires a bandwidth of 8.14 percent. Accordingly, antennas for use on these types of wireless communication devices must be designed to meet the appropriate bandwidth requirements, or communication signals are severely attenuated.

One type of antenna commonly used in wireless communication devices is the whip antenna, which is easily retracted into the device when not in use. There are, however, several disadvantages associated with the whip antenna. Often, the whip antenna is subject to damage by catching on objects, people, or surfaces when extended for use, or even when retracted. Even when the whip antenna is designed to be retractable in order to prevent such damage, it can extend across an entire dimension of the device and interfere with placement of advanced features and circuits within some portions of the device. It may also require a minimum device housing dimension when retracted that is larger than desired. While the antenna can be configured with additional telescoping sections to reduce size when retracted, it would generally be perceived as less aesthetic, more flimsy or unstable, or less operational by consumers.

Furthermore, a whip antenna has a radiation pattern that is toroidal in nature, that is, shaped like a donut, with a null at the center. When a cellular phone or other wireless device using such an antenna is held with the antenna perpendicular to the ground, at a 90 degree angle to the ground or local horizontal plane, this null has a central axis that is also inclined at a 90 degree angle. This generally does not prevent reception of signals, because incoming signals are not constrained to arrive at a 90 degree angle relative to the antenna. However, phone users frequently tilt their cellular phones during use, causing any associated whip antenna to be tilted as well. It has been observed that cellular phone users typically tilt their phones at around a 60 degree angle relative to the local horizon (30 degrees from vertical), causing the whip antenna to be inclined at a 60 degree angle. This results in the null central axis also being oriented at a 60 degree angle. At that angle, the null prevents reception of incoming signals arriving at a 60 degree angle. Unfortunately, incoming signals in cellular communication systems often arrive at angles around or in the range of 60 degrees, and there is an increasing likelihood that the mis-oriented null will prevent reception of some signals.

Another type of antenna which might appear suitable for use in wireless communication devices is a conformal antenna. Generally, conformal antennas follow the shape of the surface on which they are mounted and generally exhibit a very low profile. There are several different types of conformal antennas, such as patch, microstrip, and stripline antennas. Microstrip antennas, in particular, have recently been used in personal communication devices.

As the term suggests, a microstrip antenna includes a patch or a microstrip element, which is also commonly referred to as a radiator patch. The length of the microstrip element is set in relation to the wavelength $\lambda_0$ associated with a resonant frequency $f_0$, which is selected to match the frequency of interest, such as 800 MHz or 1900 MHz. Commonly used lengths of microstrip elements are half wavelength ($\lambda_0/_2$) and quarter wavelength ($\lambda_0/_4$). Although, a few types of microstrip antennas have recently been used in wireless communication devices, further improvement is desired in several areas. One such area in which a further improvement is desired is a reduction in overall size. Another area in which significant improvement is required is in bandwidth. Current patch or microstrip antenna designs do not appear to obtain the desired 7.29 to 8.14 percent or more bandwidth characteristics desired for use in advanced communication systems, in a practical size.

Therefore, a new antenna structure and technique for manufacturing antennas are needed to achieve bandwidths more commensurate with advanced communication system demands. In addition, the antenna structure should be conducive to internal mounting to provide more flexible component positioning within the wireless device, greatly improved aesthetics, and decreased antenna damage.

SUMMARY OF THE INVENTION

The present invention is directed to a dual strip antenna. According to the present invention, the dual strip antenna includes a first and a second strip, each made of a conductive material, such as a metallic plate. The first and second strips are separated by a dielectric material such as a dielectric substrate or air. The first strip is electrically connected to the second strip at one end. In one embodiment of the present invention, the length of the first strip is less than the length of the second strip and the surface area of the first strip is less than the surface area of the second strip.

A coaxial feed structure is connected or coupled to the dual strip antenna. In a preferred embodiment, a positive terminal of the coaxial feed is electrically connected to the first strip, and a negative terminal of the coaxial feed is electrically connected to the second strip. In another embodiment, these terminals or polarities are reversed.

In one embodiment of the present invention, the dual strip antenna is constructed by forming, folding, or bending a flat conductive strip or narrow sheet into a U-shaped structure, with each arm of the U forming one of the strips. In other embodiments, other shapes are employed for the transition, joint, or connection between the two strips. This includes, quarter-circular, semi-circular, semi-elliptical, parabolic, angular, stepped, as well as both circular and squared C-, L-, and V-shaped transitions or folds.

The dual strip antenna can also be constructed by depositing one or more layers of conductive material such as metallic compounds, conductive resins, or conductive ceramics in the form of strips on two sides of a dielectric substrate. In this technique, one end of each of the strips is electrically connected together. This electrical connection can be implemented by a variety of means, such as conductive wires, solder materials, conductive tapes, conductive compounds or one or more plated through vias. The substrate provides a desired shape or relative positioning for the strips deposited thereon.

In one embodiment of the present invention, the first and second strips are positioned approximately parallel to one another, as in two parallel planes. In another embodiment of the present invention, the first and second strips flare out at the open end as they extend away from where the first and second strips are electrically connected in order to provide improved impedance matching with air or free space.

In further embodiments of the invention, the angle used for V-shaped structures can vary from less than 90 degrees to almost 180 degrees, and curved structures can use relatively small or large radii, depending on the mounting situation within the wireless device of interest. The width of the conductors can be changed along their respective lengths such that they taper, curve, or stepwise change to a narrow width toward an outer end. Several of these features or shapes can be combined in a single antenna structure.

In one further embodiment, the end of one of the strips is formed with a transverse member so that it has a generally T-shaped end. This can be implemented by attaching a transverse member to the end of one of the strips. Alternatively, at least one of the strips is split or subdivided for a short predetermined distance along its length. One of the subdivided portions is folded or redirected at an angle to the strip, and the remaining portion is redirected or folded at the negative of that angle with respect to the strip. Typically, the angle is a 90 degree angle, although not required, as where a more Y-shaped end structure is acceptable.

For embodiments having folded elements, such as the T-shaped end, those portions of a strip can be used as a support for mounting the remainder of the antenna to a surface using bonding elements, a snap in channel, screw or other known fasteners, or fastening means. In this configuration, the antenna elements are manufactured with sufficiently thick material to prevent undue deformation of the antenna as needed. This approach also provides a simple phone assembly technique by allowing insertion of the antenna directly into the wireless device housing.

Furthermore, the shapes of the dual strip antenna strips can also vary in a third dimension. A pair of strips that are formed as flat planar surfaces in two dimensions can be curved along an arc, or folded in the third direction. Simple offsets or short curves and folds in a third dimension are also contemplated for some applications.

The dual strip antenna according to the present invention provides an increase in bandwidth over typical quarter wavelength or half wavelength patch antennas. Experimental results have shown that the dual strip antenna has a bandwidth of at least approximately 10 percent, which is very advantageous for use with wireless devices such as cellular and PCS telephones.

BRIEF DESCRIPTION OF THE DRAWINGS

The present invention is described with reference to the accompanying drawings, in which like reference numbers generally indicate identical, functionally similar, and/or structurally similar elements, the drawing in which an element first appears is indicated by the leftmost digit(s) in the reference number, and wherein:

FIG. 2 illustrates a conventional microstrip patch antenna;

FIG. 3 illustrates a side view of the microstrip patch antenna of FIG. 2;

FIG. 4 illustrates a dual strip antenna in accordance with one embodiment of the present invention;

Figure 9A:
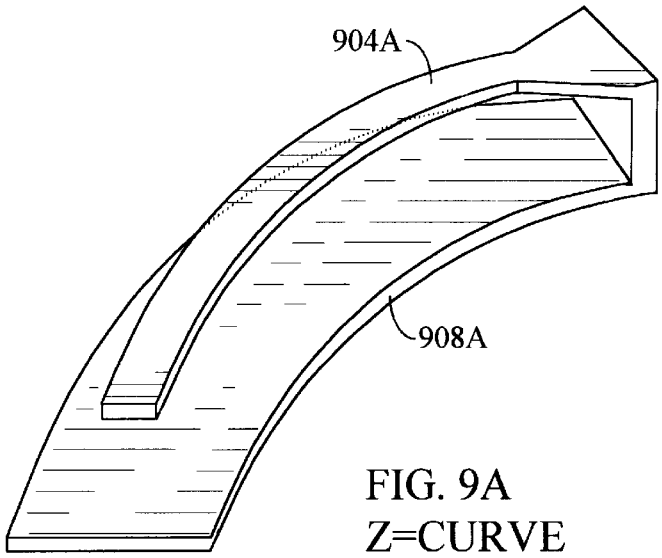
Figure 9B:
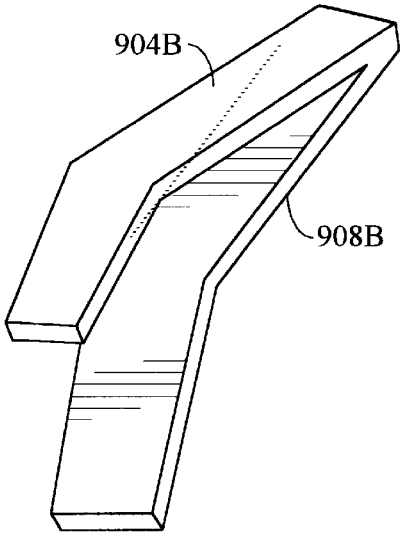
Figure 9C:
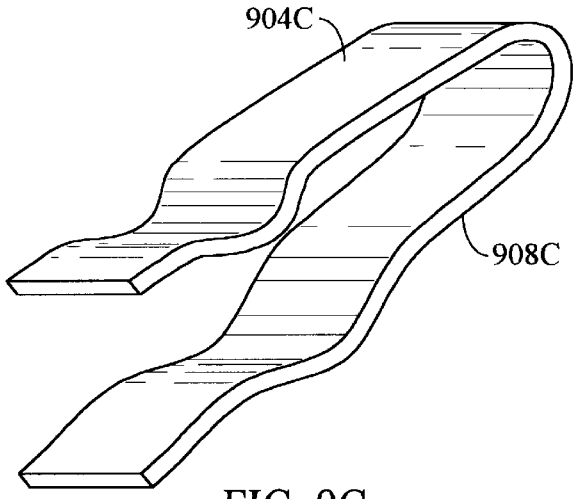
Figure 10:
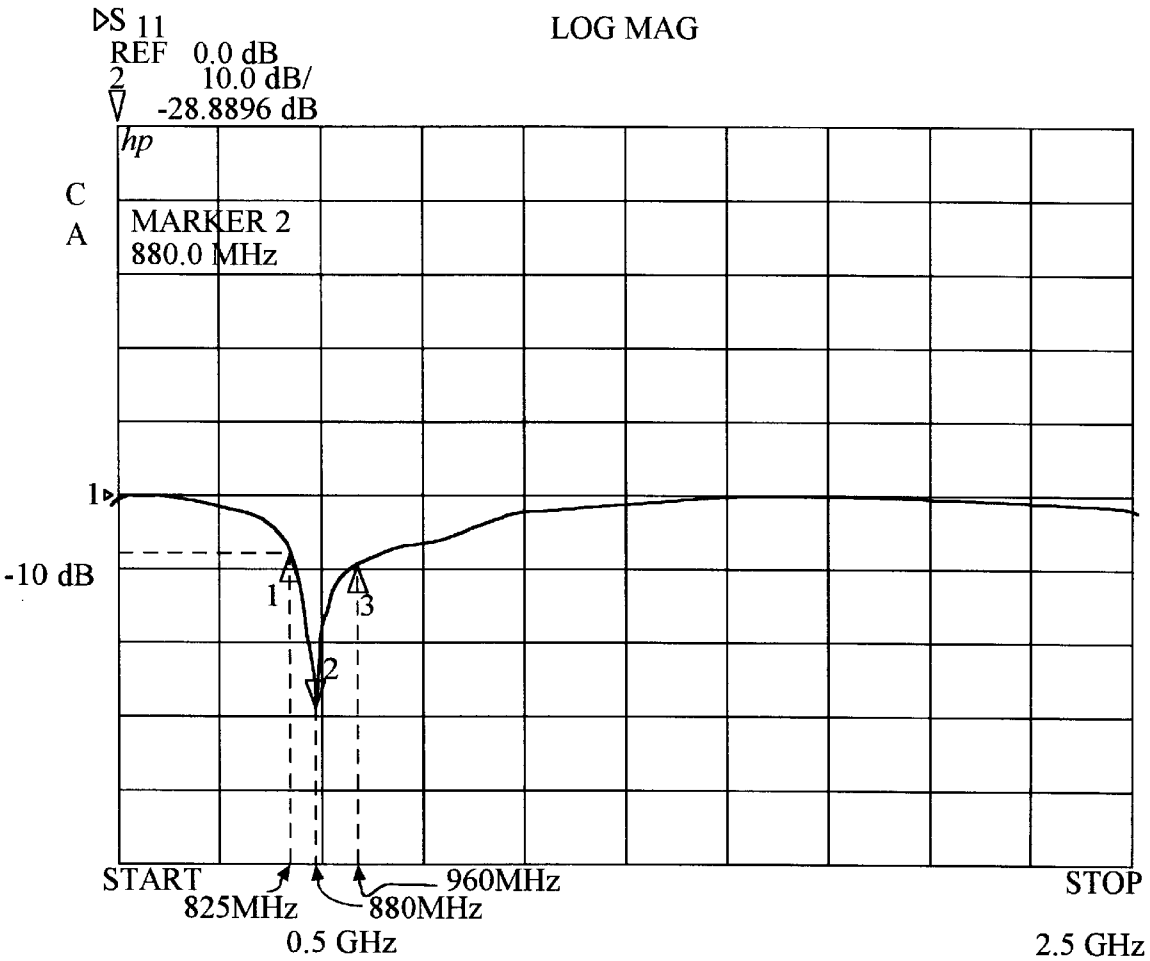
Figure 11:
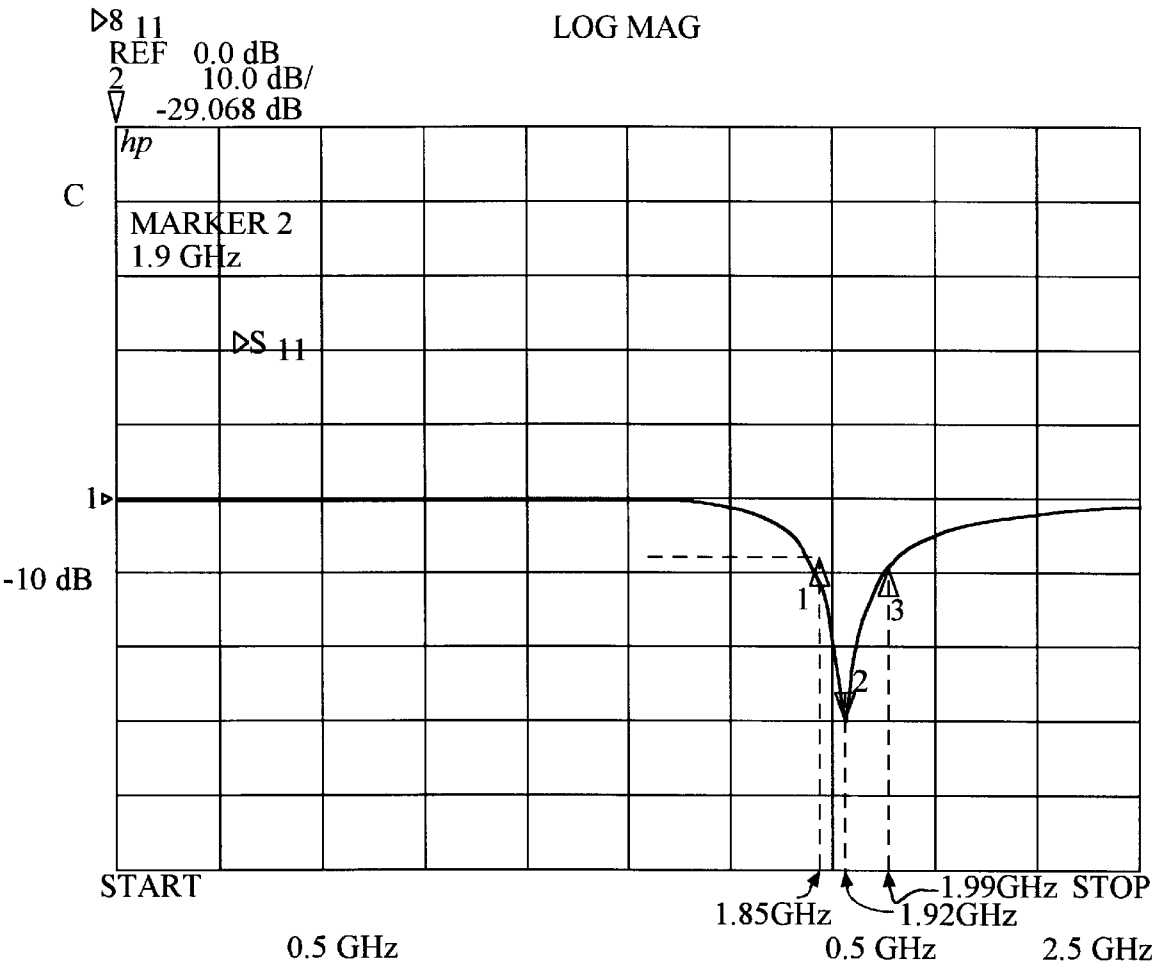
Figure 12:
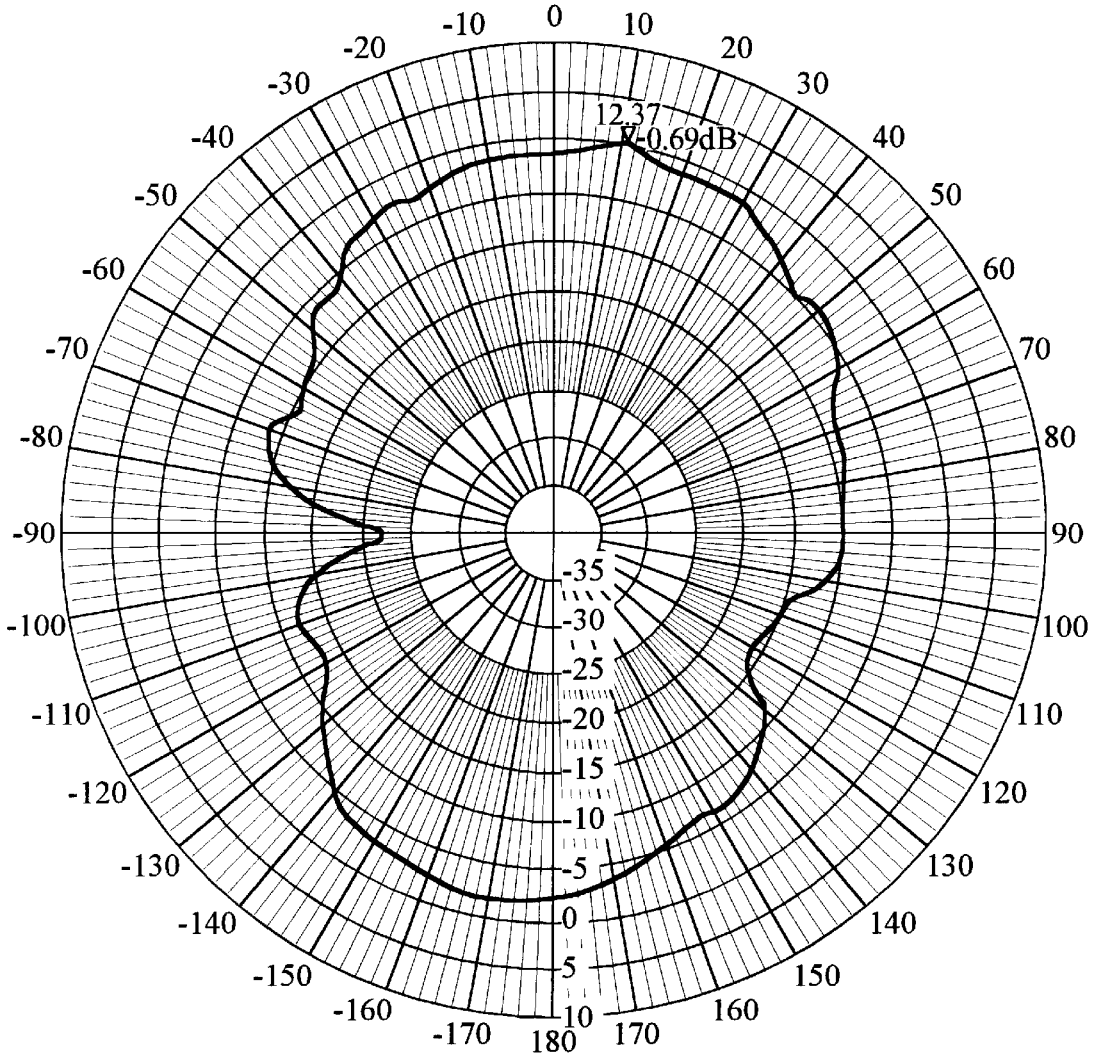
Figure 13:
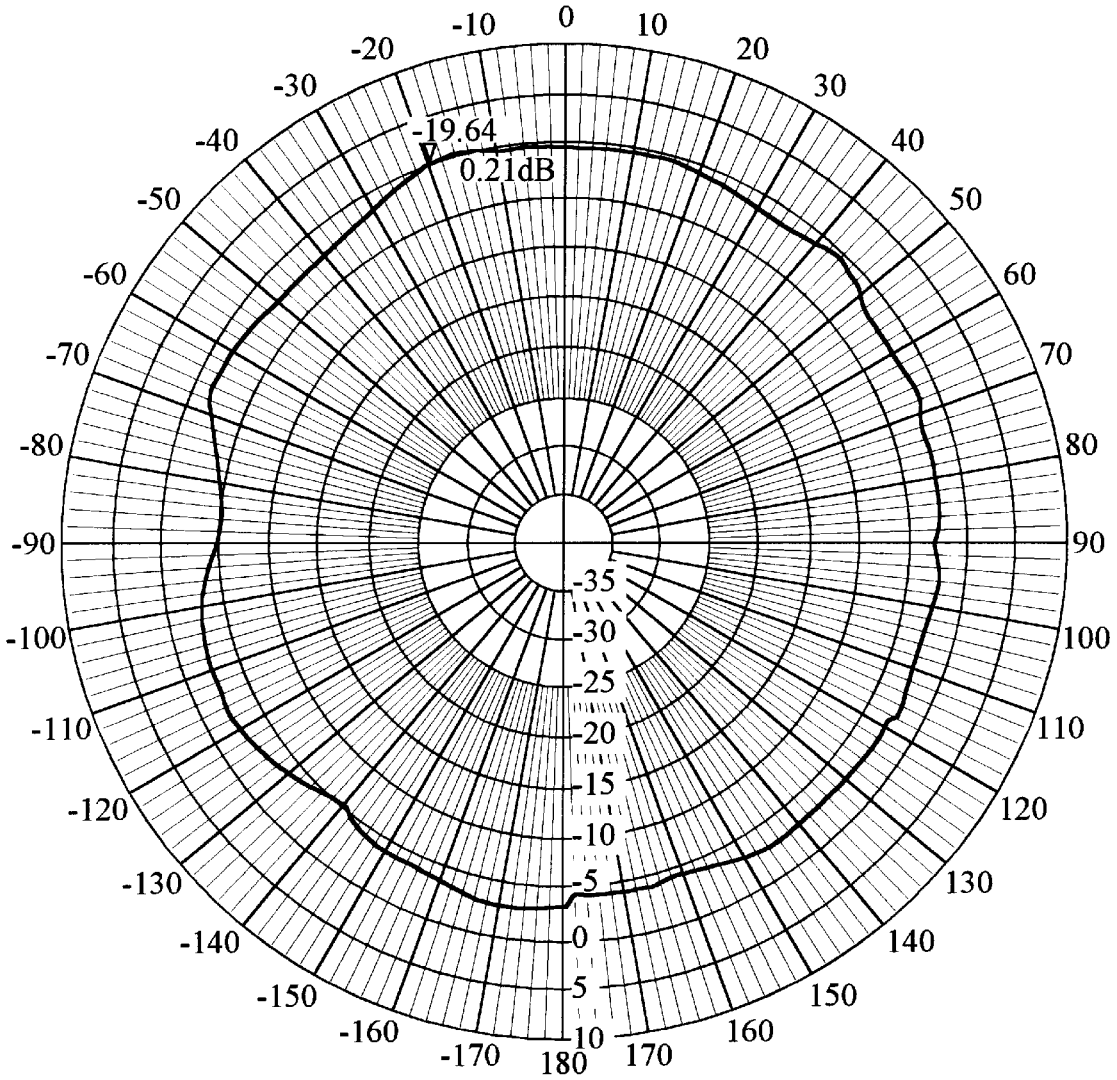
Figure 14A:
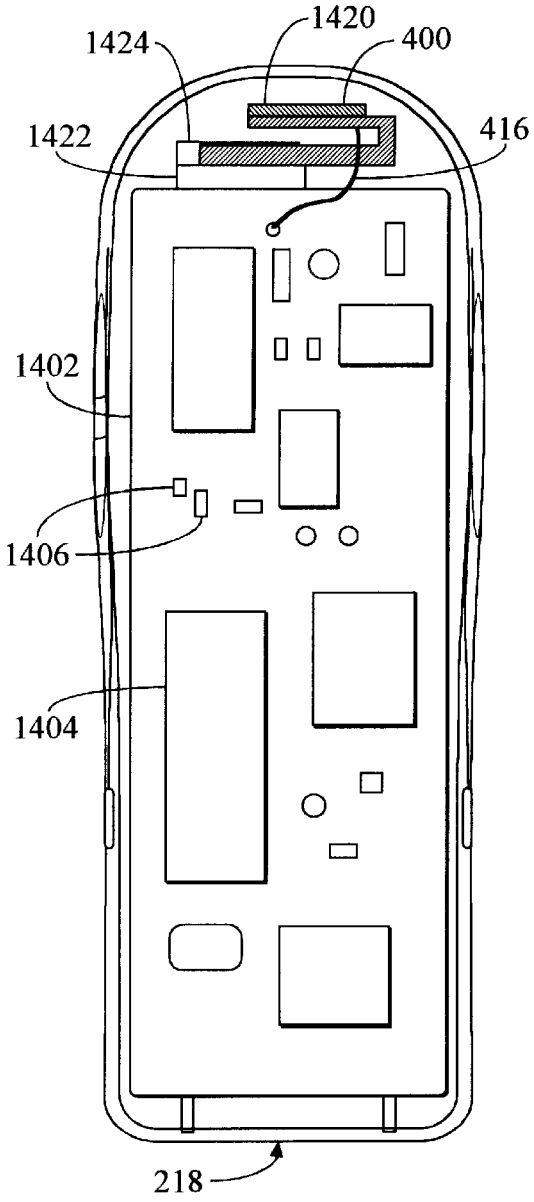
Figure 14B:
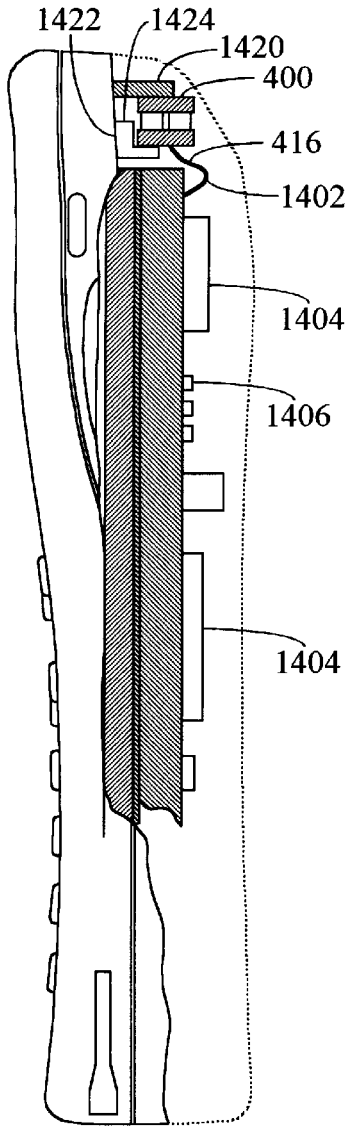

PIGS. 6A–6C illustrate cross sectional views of several other alternative embodiments of the present invention using curved transitions to connect strips;

FIGS. 7A–7E illustrate cross sectional views of another several alternative embodiments of the present invention using V-shaped transitions to connect strips;

FIGS. 8A–8F illustrate cross sectional views of yet another several alternative embodiments of the present invention using curved, angled, and compound strip shapes;

FIGS. 9A–9C illustrate perspective views of several other embodiments of the present invention useful in certain other applications;

FIG. 10 illustrates a measured frequency response of one embodiment of the present invention suitable for use in cellular phones;

FIG. 11 illustrates a measured frequency response of another embodiment of the present invention suitable for use in PCS wireless phones;

FIGS. 12 and 13 illustrate measured field patterns for one embodiment of the present invention;

FIGS. 14A and 14B illustrate side and top views of one embodiment of the present invention mounted within the phone of FIG. 1; and FIGS. 15A, 15B, 15C, and 15D illustrate additional wireless devices in which the present invention may be used.

Figure 16A:
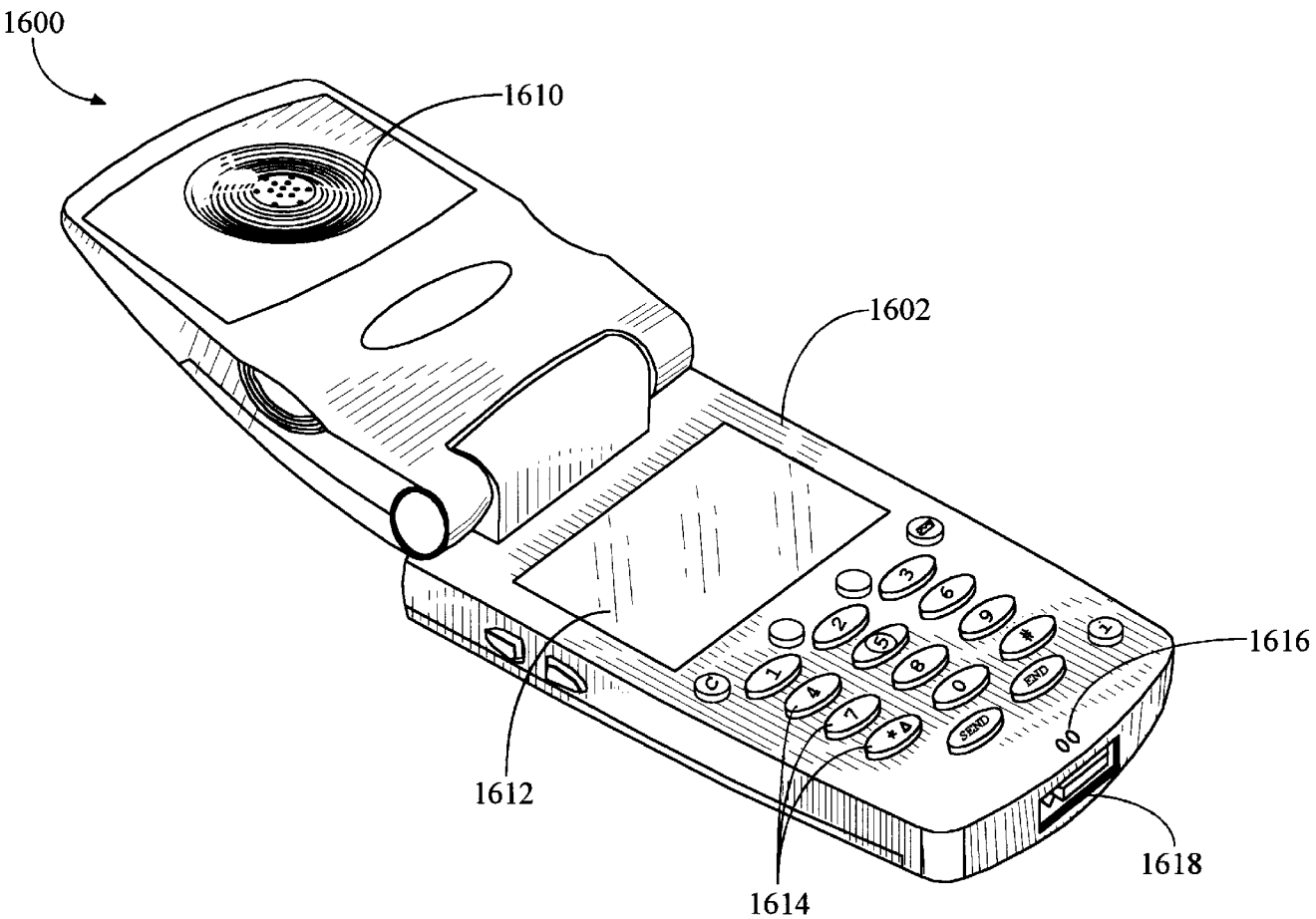
Figure 16B:
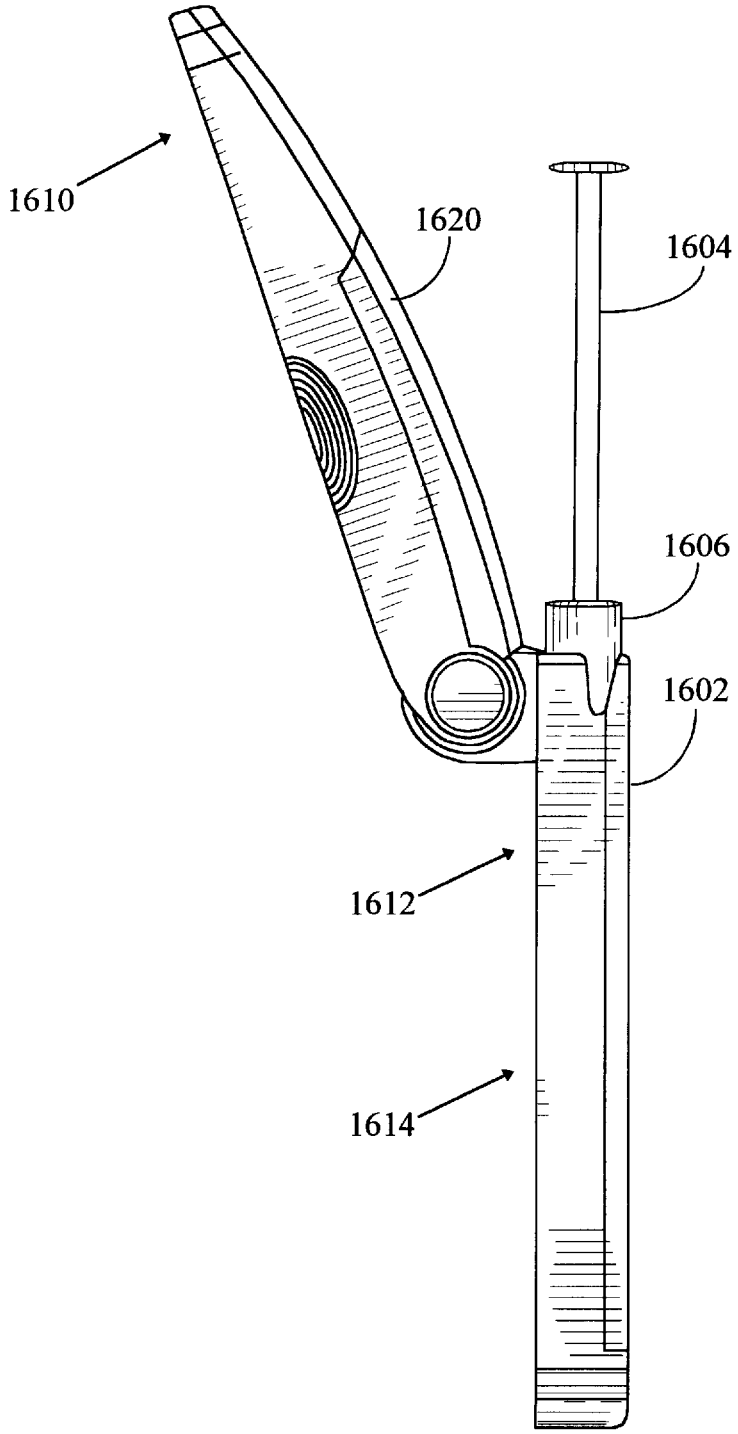
Figure 16C:
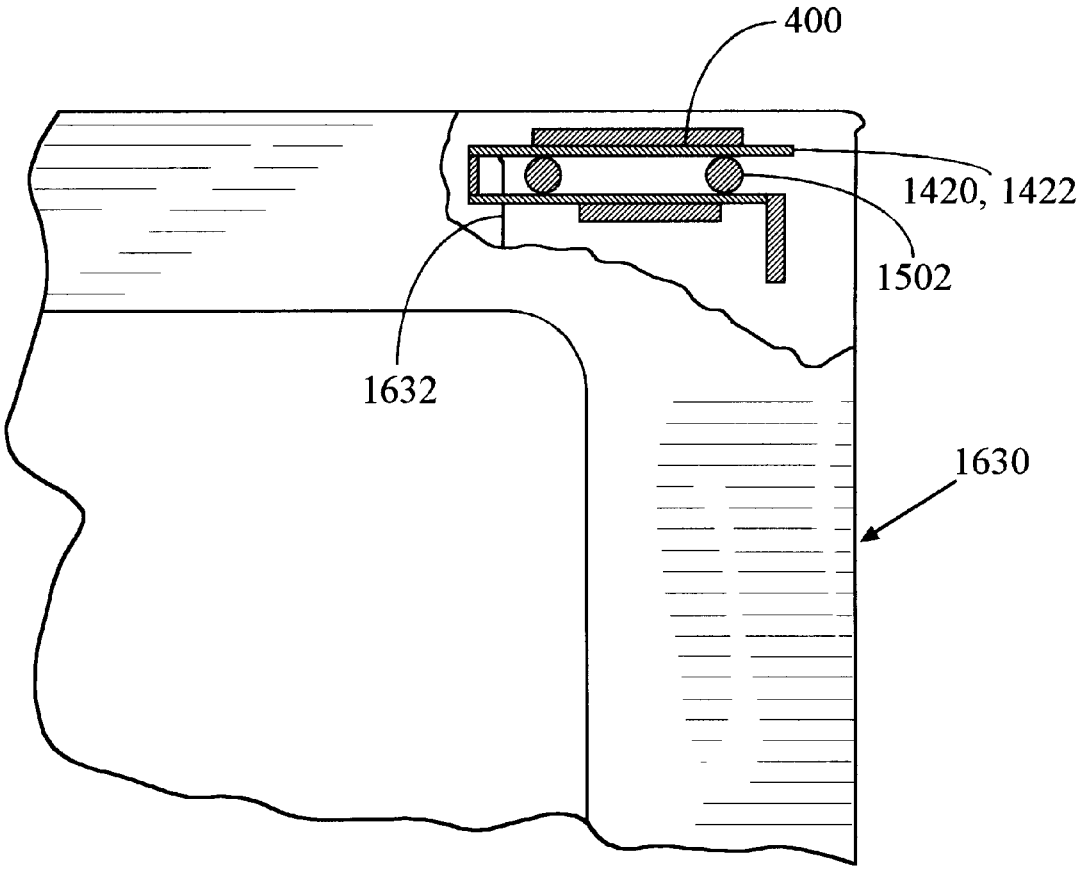

FIGS. 16A, 16B, and 16C illustrate additional wireless devices in which the present invention may be used.

DETAILED DESCRIPTION OF THE PREFERRED EMBODIMENTS

I. Overview and Discussion of the Invention

While a conventional microstrip antenna possesses some characteristics that make it suitable for use in personal communication devices, further improvement in other areas of the microstrip antenna is still desired in order to make it more desirable for use in wireless communication devices, such as cellular and PCS phones. One such area in which further improvement is desired is in bandwidth. Generally, PCS and cellular phones require approximately 8 percent bandwidth in order to operate satisfactorily. Since the bandwidth of currently available microstrip antennas falls approximately in the range of 1–2 percent, an increase in bandwidth is desired in order to be more suitable for use in PCS and cellular phones.

Another area in which further improvement is desired is the size of a microstrip antenna. For example, a reduction in the size of a microstrip antenna would make a wireless communication device in which it is used more compact and aesthetic. In fact, this might even determine whether or not such an antenna can be used in a wireless communication device at all. In the past, a reduction in the size of a conventional microstrip antenna was made possible by reducing the thickness of any dielectric substrate employed, or increasing the dielectric constant. This, however, had the undesirable effect of reducing the antenna bandwidth, thereby making it less suitable for wireless communication devices.

Furthermore, the field pattern of conventional microstrip antennas, such as patch radiators, is typically directional. Most patch radiators radiate only in an upper hemisphere relative to a local horizon for the antenna. As stated earlier, this pattern moves or rotates with movement of the device and can create undesirable nulls in coverage. Therefore, microstrip antennas have not been very desirable for use in many wireless communication devices.

The present invention provides a solution to the above and other problems. The present invention is directed to a dual strip antenna that operates as an open-ended parallel plate waveguide, but with asymmetrical conductor terminations. The dual strip antenna provides increased bandwidth and a reduction in size over other antenna designs while retaining other characteristics that are desirable for use in wireless communication devices.

The dual strip antenna according to the present invention can be built near the top surface of a wireless or personal communication device such as a portable phone or may be mounted adjacent to or behind other elements such as speakers, ear phones, I/O circuits, keypads, and so forth in the wireless device. The dual strip antenna can also be built onto or into a surface of a vehicle in which a wireless communication device may be used.

Unlike either a whip or external helical antenna, the dual strip antenna of the present invention is not susceptible to damage by catching on objects or surfaces. This antenna also does not consume interior space needed for advanced features and circuits, nor require large housing dimensions to accommodate when retracted. The dual strip antenna of the present invention can be manufactured using automation and decreased manual labor, which decreases costs and increases reliability. Furthermore, the dual strip antenna radiates a nearly omnidirectional pattern, which makes it suitable in many wireless communication devices.

II. Example Environment

Before describing the invention in detail, it is useful to describe an exemplary environment in which the invention can be implemented. In a broad sense, the invention can be implemented in any wireless device, such as a personal communication device, wireless telephones, wireless modems, facsimile devices, portable computers, pagers, message broadcast receivers, and so forth. One such environment is a portable or handheld wireless telephone, such as that used for cellular, PCS or other commercial communication services. A variety of such wireless telephones, with corresponding different housing shapes and styles, are known in the art.

Figure 1A:
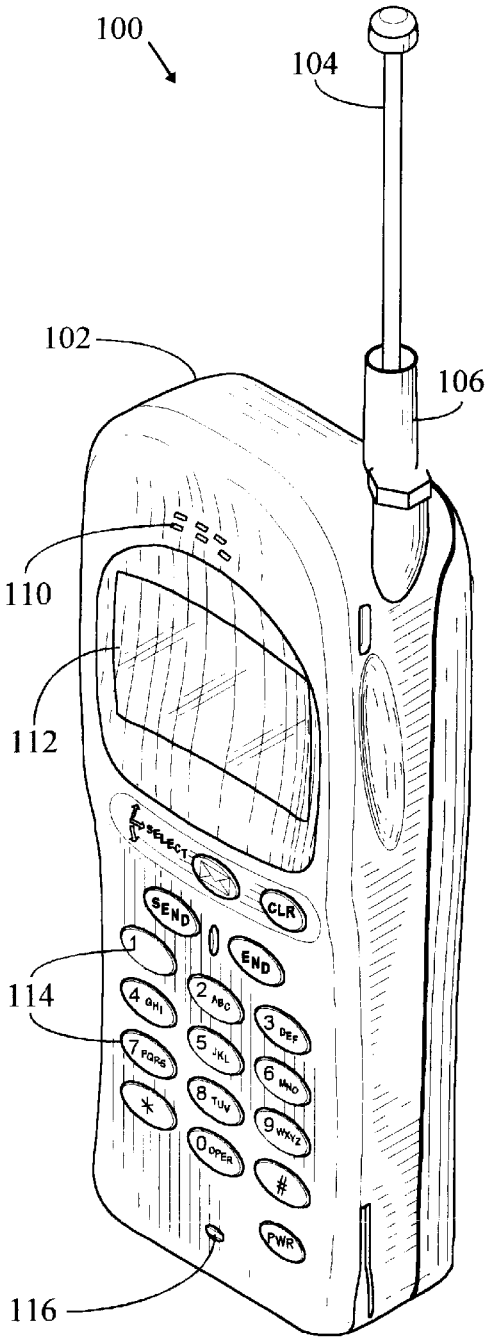
PRIOR ART FIG. 1A
FIGS. 1A and 1B illustrate a portable telephone having whip and external helical antennas.
Figure 1B:
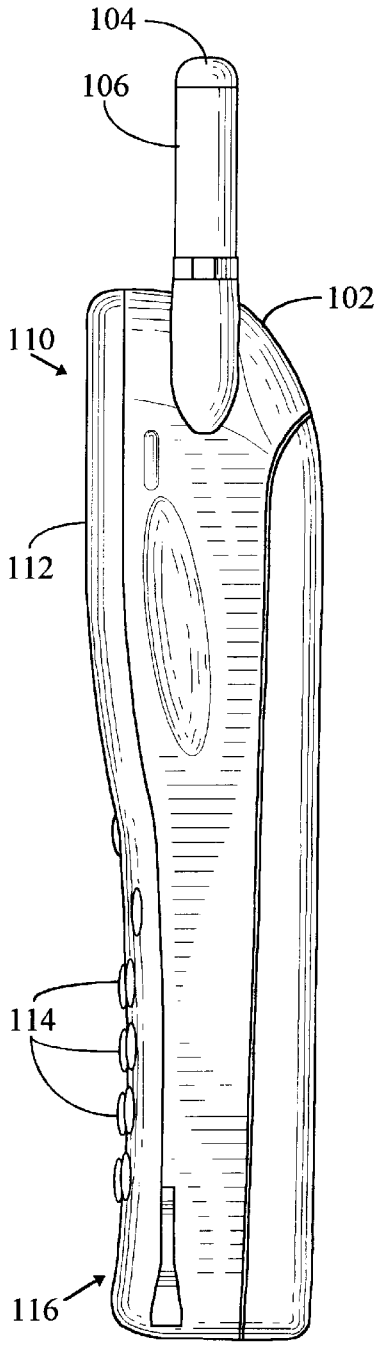
PRIOR ART FIG. 1B

FIGS. 1A and 1B, illustrate a typical wireless telephone used in wireless communication systems, such as the cellular and PCS systems discussed above. The wireless phone shown in FIG. 1 (1A, 1B) has a more traditional body shape or configuration, while other wireless phones, such as shown in FIG. 14, may have a "clam shell" or folding body configuration.

The telephone illustrated in FIG. 1 includes a whip antenna 104 and a helical antenna 106, concentric with the whip, protruding from a housing 108. The front of the housing is shown supporting a speaker 110, a display panel or screen 112, keypad 116, and a microphone or microphone access holes 118, which are typical wireless phone components, well known in the art. In FIG. 1A, antenna 104 is shown in an extended position typically encountered during use, while in FIG. 1B, antenna 104 is shown retracted. This phone is used for purposes of illustration only, since there are a variety of wireless devices and phones, and associated physical configurations, in which the present invention may be employed.

As discussed above, antenna 104 has several disadvantages. One, is that it is subject to damage by catching on other items or surfaces when extended during use, and sometimes even when retracted. Antenna 104 also consumes interior space of the phone in such a manner as to make placement of components for advanced features and circuits, including power sources such as batteries, more restrictive and less flexible. In addition, antenna 104 may require minimum housing dimensions when retracted that are unacceptably large. Antenna 106 also suffers from catching on other items or surfaces during use, and cannot be retracted into phone housing 102.

The present invention is described in terms of this example environment. Description in these terms is provided for purposes of clarity and convenience only. It is not intended that the invention be limited to application in this example environment. After reading the following description, it will become apparent to a person skilled in the relevant art how to implement the invention in alternative environments. In fact, it will be clear that the present invention can be utilized in any wireless communications device, such as, but not limited to, a portable facsimile machine or a portable computer with wireless communications capabilities, and so forth, as discussed further below.

FIG. 2 shows a conventional microstrip patch antenna 200. Antenna 200 includes a microstrip element 204, a dielectric substrate 208, a ground plane 212 and a feed point 216. Microstrip element 204 (also commonly referred to as a radiator patch) and ground plane 212 are each made from a layer of conductive material, such as a plate of copper.

The most commonly used microstrip element, and associated ground plane, consists of a rectangular element, although microstrip elements and associated ground planes having other shapes, such as circular, are also used. A microstrip element can be manufactured using a variety of known techniques including being photo etched on one side of a printed circuit board, while a ground plane is photo etched on the other side, or another layer, of the printed circuit board. There are various other ways a microstrip element and ground plane can be constructed, such as by selectively depositing conductive material on a substrate, bonding plates to a dielectric, or coating a plastic with a conductive material.

FIG. 3 shows a side view of conventional microstrip antenna 200. A coaxial cable having a center conductor 220 and outer conductor 224 is connected to antenna 200. Center conductor (positive terminal) 220 is connected to microstrip element 204 at feed point 216. Outer connector (negative terminal) 224 is connected to ground plane 212. The length L of microstrip element 204 is generally equal to one-half wavelength (for the frequency of interest) in dielectric substrate 208 (See chapter 7, page 7–2, *Antenna Engineering Handbook, Second Edition*, Richard C. Johnson and Henry Jasik), and is expressed by the following relationship:

$$L=0.5\lambda_d=0.5\lambda_0/\sqrt{\epsilon},$$

where L=length of microstrip element 204

$\epsilon_r$=relative dielectric constant of dielectric substrate 208

$\lambda_0$=free space wavelength $\lambda_d$=wavelength in dielectric substrate 208

The variation in dielectric constant and feed inductance makes it hard to predict exact dimensions, so a test element is usually built to determine the exact length. The thickness t is usually much less than a wavelength, usually on the order of 0.01 $\lambda_0$, to minimize or prevent transverse currents or modes. The selected value of t is based on the bandwidth over which the antenna must operate, and is discussed in greater detail later.

The width "w" of microstrip element 204 must be less than a wavelength in the dielectric substrate material, that is, $\lambda_d$, so that higher-order modes will not be exited. An exception to this is where multiple signal feeds are used to eliminate higher-order modes.

A second microstrip antenna commonly used is the quarter wavelength microstrip antenna. The ground plane of the quarter wavelength microstrip antenna generally has a much larger area than the area of the microstrip element. The length of the microstrip element is approximately a quarter wavelength at the frequency of interest in the substrate material. The length of the ground plane is approximately one-half wavelength at the frequency of interest in the substrate material. One end of the microstrip element is electrically connected to the ground plane.

The bandwidth of a quarter wavelength microstrip antenna depends on the thickness of the dielectric substrate. As stated before, PCS and cellular wireless phone operations require a bandwidth of approximately 8 percent. In order for a quarter wavelength microstrip antenna to meet the 8 percent bandwidth requirement, the thickness of dielectric substrate 208 must be approximately 1.25 inches for the cellular frequency band (824–894 MHz) and 0.5 inches for the PCS frequency band. This large of a thickness is clearly undesirable in a small wireless or personal communication device, where a thickness of approximately 0.25 inches or less is desired. An antenna with a larger thickness typically cannot be accommodated within the available volume of most wireless communication devices.

III. The Present Invention

A dual strip antenna 400 which is constructed and operating according to one embodiment of the present invention is shown in FIG. 4. In FIG. 4, dual strip antenna 400 includes a first strip 404, a second strip 408, a dielectric substrate 412 and a coaxial feed 416. First strip 404 is electrically connected to second strip 408 at or adjacent to one end. The first and second strips are each made of a conductive material such as, for example, copper, brass, aluminum, silver or gold. First and second strips 404 and 408 are spaced apart from each other by a dielectric material or substrate, such as air or a foam (see FIG. 5C) known for such uses.

In one embodiment of the present invention, first and second strips 404 and 408 are positioned substantially parallel to one another. In another embodiment (see, for example, FIGS. 7A–7C and 9B), the first and second strips flare out at an open end in order to provide better impedance matching with air or free space.

The length of first strip 404 primarily determines the resonant frequency of dual strip antenna 400. In dual strip antenna 400, the length of first strip 404 is sized appropriately for a particular operating frequency. In a conventional quarter wavelength microstrip antenna, the length of the radiator patch is approximately $\lambda/_4$, where $\lambda$ is a wavelength at the frequency of interest of an electromagnetic wave in free space. In dual strip antenna 400, the length of first strip 404 is approximately 20 percent less than the length of the radiator patch of a quarter wavelength microstrip antenna operating at the same frequency. The length of second strip 408 is approximately 40 percent less than the length of the ground plane of a quarter wavelength microstrip antenna operating at the same frequency. Thus, the present invention allows a significant reduction in the overall length of the antenna, thereby making it more desirable for use in personal communication devices.

Generally, the ground plane of a conventional microstrip antenna is required to be much larger than the radiator patch. Typically, it is at least one-half of the wavelength in dimension in order to work properly. In dual strip antenna 400, the area of second strip 408 is much smaller than the area of the ground plane of a conventional microstrip antenna, thereby significantly reducing the overall size of the antenna.

A coaxial feed 416 is coupled to dual strip antenna 400. One terminal, here the positive terminal or inner conductor, is electrically connected to first strip 404. The other terminal, here the negative terminal or outer conductor, is electrically connected to second strip 408. Coaxial feed 416 couples a signal unit (not shown), such as a transceiver or other known wireless device or radio circuitry to dual strip antenna 400. Note that the signal unit is used herein to refer to the functionality provided by a signal source and/or signal receiver. Whether the signal unit provides one or both of these functions depends upon how antenna 400 is configured to operate with the wireless device. Antenna 400 could, for example, be used or operated solely as a transmission element, in which case the signal unit operates as a signal source. Alternatively, the signal unit operates as a signal receiver when antenna 400 is used or operated solely as a reception element. The signal unit provides both functions (as in a transceiver) when antenna 400 is connected or used as both transmission and receiver elements.

The dual strip antenna constructed according to the present invention provides an increase in bandwidth over typical quarter wave-length or half wave-length patch antennas. Experimental results have shown that the dual strip antenna has a bandwidth of approximately 10 percent, which is extremely desirable for wireless telephones. The increase in bandwidth is made possible primarily by operating the dual strip antenna as an open-ended parallel plate waveguide, but with asymmetrical conductor terminations, rather than as a conventional microstrip patch antenna. Unlike a conventional microstrip patch antenna having a radiator patch and a ground plane, in the dual strip antenna, both the first and second strips act as active radiators. During operation of the dual strip antenna, surface currents are induced in the first strip as well as in the second strip. The operation of the dual strip antenna as an open-ended parallel plate waveguide is made possible by selecting appropriate dimensions, that is, length and width, for the first and second strips. In other words, the length and the width of the first and second strips are carefully sized so that both the first and second strips perform as active radiators. The inventor selected appropriate dimensions of the first and second strips by using analytical methods and EM simulation software that are well known in the art. The simulation results were verified using known experimental methods.

In the present invention, the increase in bandwidth is achieved without a corresponding increase in the size of the antenna. This is contrary to the teachings of conventional patch antennas in which the bandwidth is generally increased by increasing the thickness of the patch antennas, thereby resulting in larger overall size for patch antennas. Thus, the present invention allows the dual strip antenna to have a relatively small overall size and, thus, become more suitable for wireless communication devices, such as PCS and cellular phones.

In one embodiment of the present invention, dual strip antenna 400 is constructed by bending a flat conductor sheet into a U-shape. A variety of other shapes, such as, but not limited to, quarter-circular, semi-circular, semi-elliptical, parabolic, angular, both circular and squared C-shaped, L-shaped, and V-shaped can be used, depending on space and mounting restrictions or requirements. The angle used at the joint for V-shaped structures can vary from less than 90 degrees to almost 180 degrees. The curved structures can use relatively small or large radii.

The width of the conductors can be changed along their respective lengths such that they taper, curve, or stepwise change to a narrower or wider width toward the outer end (non-feed portion). As will be clearly understood by those skilled in the art, several of these effects or shapes can be combined in a single antenna structure. For example, an angled stepped strip placed over a corresponding second strip which are both then curved or folded in another dimension is possible.

Figure 5A:
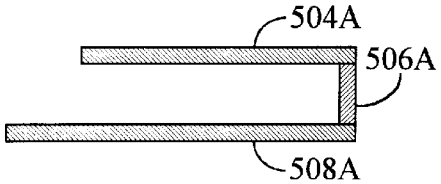
FIGS. 5A–5I illustrate cross sectional views of several alternative embodiments of the present invention using square transitions to connect strips.

Several cross-sectional views of alternative embodiments or shapes for the strips of the present invention are shown in FIGS. 5A–5G, 6A–6C, 7A–7D and 8A–8F, where the last digit of the reference numerals indicates first or second strip, that is, 4 or 8, respectively. The first number and last character indicate the figure in which the element appears, as in 504A for FIG. 5A, 708B for FIG. 7B, and so forth.

The cross sections of antenna embodiments shown in FIGS. 5A–5I illustrate alternative shapes for the present invention using rectangular or square transitions to connect the strips together. That is, in the embodiments shown in FIGS. 5A–5I, the first and second strips are connected or joined together using a substantially straight conductive connection element or transition strip 506 (506A–506I). In addition, further changes in direction for the strips relative to each other are accomplished with substantially square corners. Each change in direction involves positioning a new portion of each strip substantially perpendicular, or at a 90 degree angle, to a previous portion. Of course, these angles need not be precise for most applications and other angles can be employed, along with curved or chamfered corners, as desired.

Figure 5B:
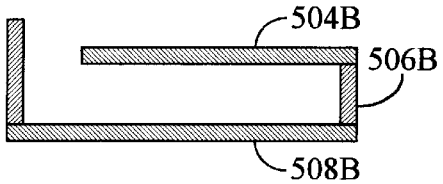
Figure 5C:
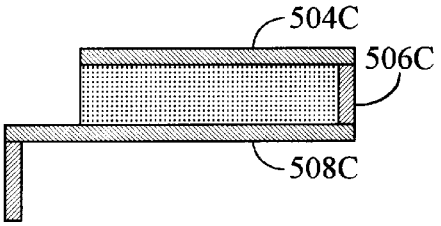
Figure 5D:
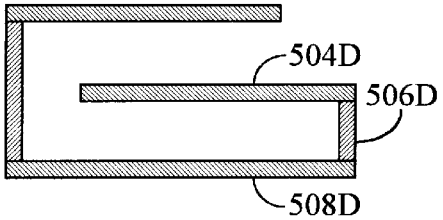
Figure 5E:
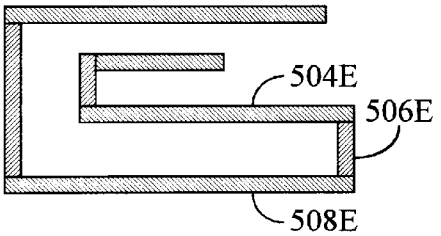
Figure 5F:
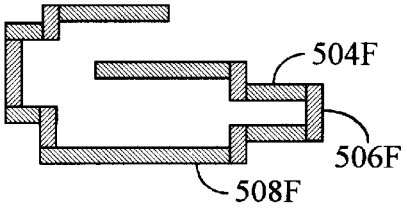

FIG. 5B shows that in order to accommodate a longer second strip, that strip can be folded to maintain an overall desired length for the antenna structure. FIG. 5C shows that the fold can be either toward or away from the plane in which the first strip lays. FIG. 5D shows that the second strip can be folded back around, either partially or completely, the first strip. While FIG. 5E shows the extension of the first strip through a folded architecture as well. FIG. SF shows changes in direction for the first and second strips being accomplished in smaller "steps".

Figure 5G:
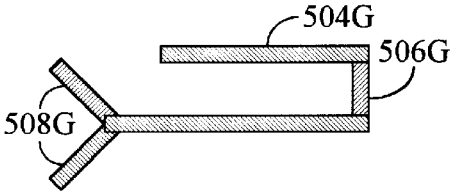
Figure 5H:
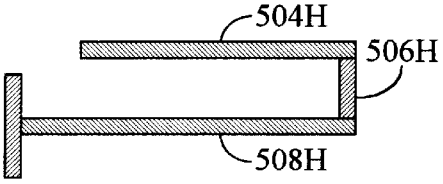
Figure 5I:
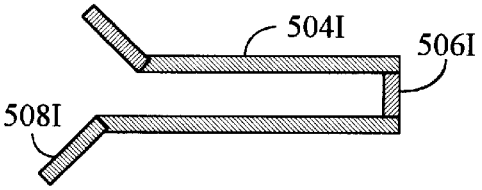
Figure 6A:
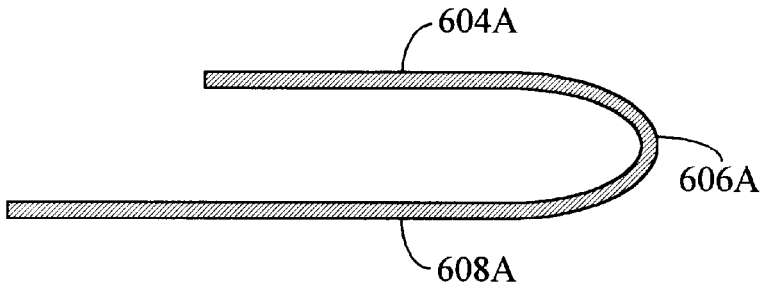
Figure 6B:
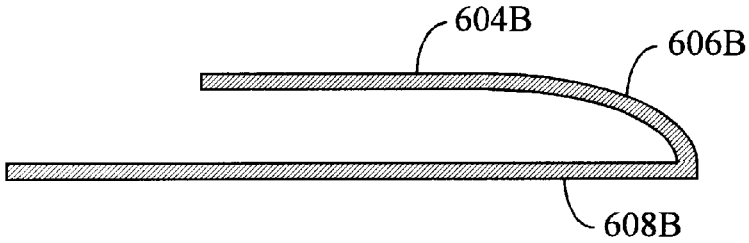
Figure 6C:
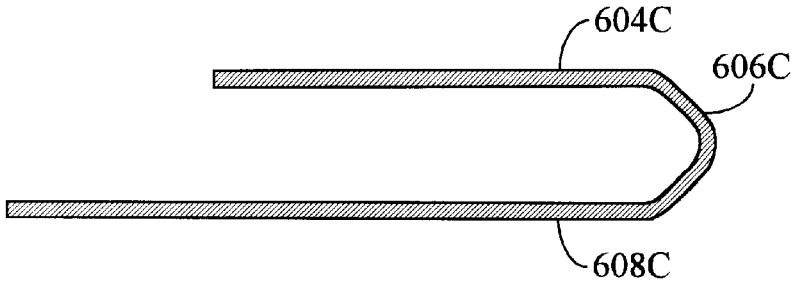

FIGS. 5G and 5H, in particular, show embodiments wherein one of the strips has either a T-shaped or Y-shaped end. In these configurations, the T- or Y-shaped ends can be used as a support for mounting the rest of the antenna to some surface using bonding elements, a snap in channel, screws or other known fasteners. The T- or Y-shape can be formed by attaching another strip 510 on the end of strip 508F or by splitting a portion of the end of strip 508F along a longitudinal axis, that is its length, and directing one portion upward and the other downward, relative to the rest of the strip. Alternatively, an end portion of each strip can be bent or directed at an angle, as shown in FIG. 5I, to form the overall Y-shape. Here, the antenna elements, including the T- or Y-shaped (angled) ends, may be constructed with sufficiently thick material to support the weight of the entire antenna, and maintain the desired spacing without deforming. This type of structure provides a simple wireless device and antenna assembly technique. Typically, the angle is a 90 degree angle, although not required, as where a more Y-shaped end structure is acceptable The cross sections of antenna embodiments shown in FIGS. 6A–6C illustrate alternative shapes for the present invention using curved or curvilinear transitions to connect the strips together. That is, in the embodiments shown in FIGS. 6A–6C, the first and second strips are connected or joined together using a curved conductive connection element or transition strip 606. Strip 606 can have a variety of shapes including, but not limited to, quarter-circular, semi-circular, semi-elliptical, or parabolic, or combinations of thereof. The curved structures can use relatively small or large radii, as desired for a particular application. In addition, each of the strips can be folded to maintain an overall desired length for the antenna structure, as shown in FIGS. 5A–5I. FIG. 6A shows a generally semi-circular curved transition, FIG. 6B shows a generally quarter-circular, or elliptical, curved transition, and FIG. 6C shows a generally parabolic curved transition. These types of transitions can also be used in combination.

The cross sections of antenna embodiments shown in FIGS. 7A–7E illustrate alternative shapes for the present invention using V-shaped transitions to connect the strips together. That is, in the embodiments shown in FIGS. 7A–7E, the first and second strips are connected or joined together without using a separate conductive connection element or transition strip, or by using a very small one. Instead, the first and second strips extend from a common joint in an outward separation or flared configuration. In addition, as before, each of the strips can be folded to maintain an overall desired length for the antenna structure, as shown in FIGS. 5A–5H.

Figure 7A:
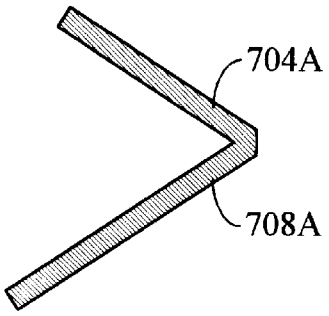
Figure 7B:
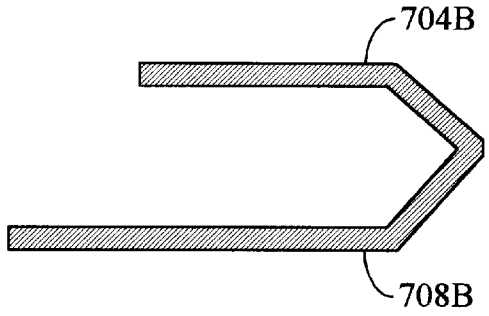
Figure 7C:
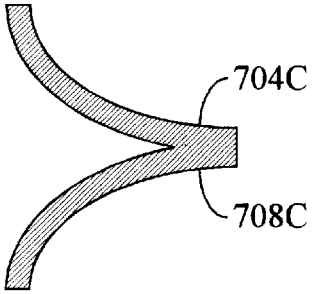
Figure 7D:
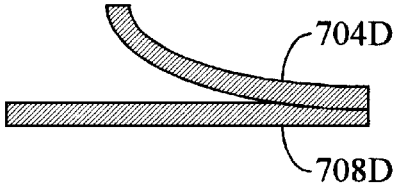
Figure 7E:
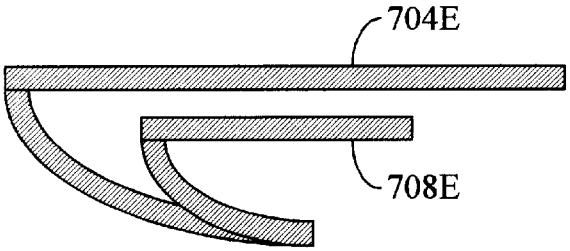
Figure 8A:
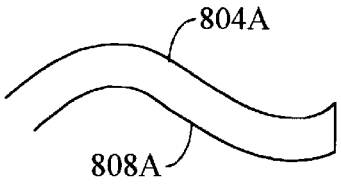
Figure 8B:
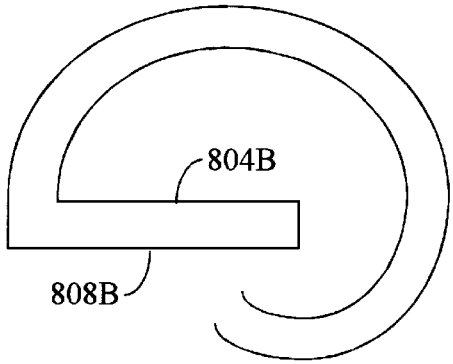
Figure 8C:
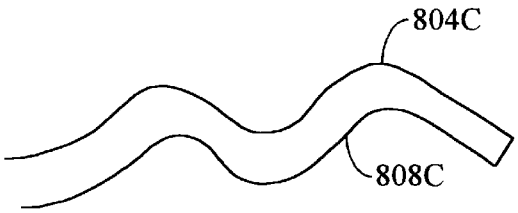
Figure 8D:
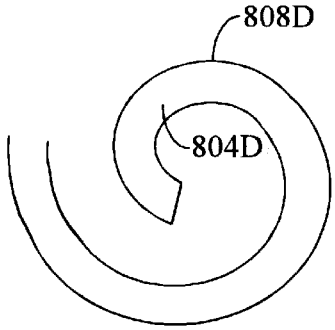
Figure 8E:
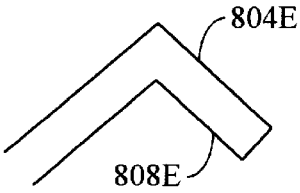
Figure 8F:
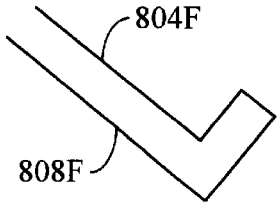

FIGS. 7A and 7B, show a generally straight V-shaped or acute angular transition where they join together. In FIG. 7B, the two strips bend again to form generally parallel strips, or to provide a decreased angular slope with respect to each other. In FIGS. 7C–7E, at least one of the two strips is curved after the initial V-shaped joint. In FIG. 7C, both strips are curved, such as in following an exponential or parabolic curve function. In FIG. 7D, only one strip is curved, and in FIG. 7E, both strips are curved, but fold into straight sections. As before, these types of transitions can also be used in combination, as desired, for a particular application.

FIGS. 8A–8F illustrate several alternative embodiments or shapes for the strips of the present invention using curved, angled, and compound strips. Here, the strips are positioned substantially parallel to each other over their respective lengths, but follow circular, serpentine, or V-shaped paths extending outward from where they are connected or joined together using a conductive connection element or transition strip 806 (806A–806F).

Furthermore, the shapes of the dual strip antenna can also vary in a third dimension. A pair of strips that appear as flat planar surfaces in two dimensions can be curved along an arc or be bent at an angle in a third dimension (here z). Several embodiments of the present invention wherein a pair of strips curve or bend in the z direction are shown in FIGS. 9A–9C, where the last digit of the reference numerals indicates first or second strip. These embodiments are very useful when the antenna is desired to be placed within certain spaces in a wireless device which might require the antenna to be "fit" around certain components or structures within the device.

FIG. 9A shows the first and second strips as seen in FIG. 4 residing in two planes that are substantially parallel to each other. However, each strip is also curved in shape, along a third dimension, within each plane. FIG. 9B shows the first and second strips as seen in FIG. 7A being connected together in a V-shape or acute angular transition when viewed in two dimensions. However, the two strips also have large angular displacements in a third dimension, as well as the first strip tapering toward the open end. In FIG. 9C, the two strips have a generally U-shaped transition where they join together and form two generally parallel strips with respect to each other in two dimensions. However, both strips have a curved offset part way along their respective lengths, as seen in a third dimension.

Dual strip antenna 400 can also be constructed by etching or depositing a metallic strip on two sides of a dielectric substrate and electrically connecting the metallic strips together at one end by using one or more plated through vias, jumpers, connectors, or wires. Dual strip antenna 400 can also be constructed by molding or forming a plastic material into a support structure having a desired shape (U-, V-, or C-shaped, or curved, rectangular, and so forth) and then plating or covering the plastic with conductive material over appropriate portions using well known methods, including conductive material in liquid form.

Dual strip antenna 400 provides a significantly broader bandwidth than conventional microstrip antennas. As noted before, conventional microstrip antennas have very narrow bandwidths, making them less desirable for use in personal communication devices, or even entirely unusable. In contrast, dual strip antenna 400 provides approximately 10 percent bandwidth, thus, making it suitable for use in wireless communication devices.

In the present invention, the increase in bandwidth is made possible primarily by operating dual strip antenna 400 as an open-ended parallel plate waveguide, but with asymmetrical conductor terminations. In contrast, the bandwidth of conventional patch radiators is typically increased by increasing the thickness of the dielectric substrate. However, increasing the thickness increases the overall size of the patch radiator antenna making it less desirable or even impractical for use in wireless communication devices.

In dual strip antenna 400, both first and second strips 404 and 408 function as active radiators, i.e., an open-ended waveguide. This is made possible by selecting appropriate dimensions, that is, the length and the width, of first and second strips 404 and 408. In other words, the length and the width of first and second strips are carefully sized so that both the first and second strips 404 and 408 perform as active radiators, at the wavelength or frequency of interest.

In order to enhance the radiator or antenna bandwidth, the dimensions of each strip, in a preferred embodiment, are chosen to establish different center frequencies which are related to each other in a preselected manner. For example, say that $f_0$ is the desired center frequency of the antenna. The length of the shorter strip can be chosen such that its center frequency resides at or around $f_0+\Delta f$, and the length of the longer strip such that its center frequency is at or around $f_0-\Delta f$. This provides the antenna with a wide bandwidth on the order of from $3\Delta f/f_0$ to $4\Delta f/f_0$. That is, the use of the +/− frequency offset relative to $f_0$ results in a scheme that enhances the antenna radiator bandwidth. In this configuration, $\Delta f$ is selected to be much smaller in magnitude than $f_0$ ($\Delta f << f_0$) so the resonant frequency separation of the two strips is small. Its is believed that the antenna will not perform satisfactorily if $\Delta f$ is chosen to be as large as $f_0$. In other words, this is not intended for use as a dual-band antenna with each strip acting as an independent antenna radiator.

In one embodiment of the present invention, dual strip antenna 400 is sized appropriately for the cellular frequency band, that is, 824–894 MHz. The dimensions of dual strip antenna 400 for the cellular frequency band are given below in Table I.

TABLE I

| | |
|---|---|
| length (L1) of first strip 404 | 3.0 inches |
| length (L2) of second strip 408 | 4.9 inches |
| width (W1) of first strip 404 | 0.2 inches |
| width (W2) of second strip 408 | 0.4 inches |
| thickness (T) of dielectric substrate 412 | 0.3 inches |

In the above embodiment, 0.010 inch thick brass was used to construct first and second strips 404 and 408, and air was used as dielectric substrate 412. The positive terminal of coaxial feed 416 was also connected to first strip 404 at a distance of 0.3 inches from the closed end (shorted end) of the antenna. Using material of such a thickness, or greater, allows the mechanical structure of the antenna itself to support first strip 404 above the second strip 408. Otherwise, spacers or supports of non-conductive material (or dielectric) are used to position the two strips relative to each other, using well known techniques.

The entire antenna or the strips can also be secured within portions of the wireless device housing using posts, ridges, channels, or the like formed in the material used to manufacture the housing. That is, such supports are molded, or otherwise formed, in the wall of the device housing when manufactured, such as by injection molding. These support elements can then hold conductive strips in position when inserted between them, or inside them, during assembly of the phone.

FIG. 10 shows a measured frequency response of one embodiment of dual strip antenna 400 sized to operate over the cellular frequency band. FIG. 10 shows that the antenna has a −7.94 dB frequency response at 825 MHz and a −9.22 dB frequency response at 960 MHz. Thus, the antenna has a 15.3 percent bandwidth.

In another embodiment of the present invention, dual strip antenna 400 is sized to operate over the PCS frequency band, that is, 1.85–1.99 GHz. The dimensions of dual strip antenna 400 for the PCS frequency band is given below in Table II.

TABLE II

| | |
|---|---|
| length (L1) of first strip 404 | 1.34 inches |
| length (L2) of second strip 408 | 2.21 inches |
| width (W1) of first strip 404 | 0.2 inches |
| width (W2) of second strip 408 | 0.2 inches |
| thickness (T) of dielectric substrate 412 | 0.08 inches |

In the above embodiment, 0.010 inch thick brass was used to construct first and second strips 404 and 408, and Rohacell foam ($\epsilon_r$=1.05) was used to manufacture dielectric substrate 412. Also, the positive terminal of coaxial feed 416 was connected to first strip 404 at a distance 0.2 inches from the closed end (shorted end) of the antenna.

FIG. 11 shows a measured frequency response of one embodiment of dual strip antenna 400 sized to operate over the PCS frequency band. FIG. 11 shows that the antenna has a −10 dB response at 1.85 GHz and at 1.99 GHz.

FIGS. 12 and 13 show measured field patterns for one embodiment of dual strip antenna 400 operating over the PCS frequency band. Specifically, FIG. 12 shows a plot of magnitude of the field energy in the azimuth plane, while FIG. 13 shows a plot of magnitude of the field energy in the elevation plane. Both FIGS. 12 and 13 show that the dual strip antenna has an approximately omnidirectional radiation pattern, thereby making it suitable for use in many wireless communication devices.

FIGS. 14A and 14B illustrate side and rear cutaway section views, respectively, of one embodiment of the present invention mounted within the phone of FIG. 1. Such phones have various internal components generally supported on one or more circuit broads for performing the various functions needed or desired. In FIGS. 14A and 14B, a circuit board 1402 is shown inside of housing 102 supporting various components such as integrated circuits or chips 1404, discrete components 1406, such as resistors and capacitors, and various connectors 1408. The panel display and keyboard are typically mounted on the reverse side of board 1402, facing the front of phone housing 102, with wires and connectors (not shown) interfacing the speaker, microphone, or other similar elements to the circuitry on board 1402.

In the side view of FIG. 14A, circuit board 1402 is shown as comprising multiple layers of conductive and dielectric materials, bonded together to form what is referred to in the art as a multi-layer or printed circuit board (PCB). Such boards are well known and understood in the art. This is illustrated as dielectric material layer 1412 disposed next to metallic conductor layer 1414 disposed next to dielectric material layer 1416 supporting or disposed next to metallic conductor layer 1418. Conductive vias are used to interconnect various conductors on different layers or levels with components on the outer surfaces. Etched patterns on any given layer determine interconnection patterns for that layer. In this configuration, either layer 1414 or 1418 could form a ground layer or ground plane for board 1402, as would be known in the art.

A dual strip antenna 1400 is shown mounted near an upper portion of the housing adjacent to circuit board 1402. In FIGS. 14A and 14B, a ridge 1420 is shown adjacent to an upper strip, here strip one, of antenna 400, while a ridge 1422 is shown adjacent to a lower strip of the antenna. In this configuration ridge 1422 is also formed with an optional support lip or ledge 1424 for spacing the antenna from an adjacent housing wall. Both of the ridges can employ such ledges, or not, as desired. Antenna 400 can simply be secured between the ridges using a frictional or pressure fit, or by using one of several known adhesives or bonding compounds known to be useful for this function.

As discussed earlier, the antenna can be secured within portions of the wireless device housing using posts, ridges, channels, or the like formed in the material used to manufacture the housing. These support elements can then hold conductive strips in position when inserted between them, or inside them, during assembly of the phone. Alternatively, antenna 1400 is held in place using adhesives, or similar techniques to secure the antenna against the side of the housing, preferably over an insulating material, or against a bracket assembly which can be mounted in place using brackets, screws, or similar fastening elements.

Some of these alternative mechanisms for mounting the antenna in place are illustrated in the views of FIGS. 15A–15D. A series of bumps is shown in 15A, the use of adhesives in 15B , the use of compounds in 15C.

A series of protrusions or bumps 1502 and 1504 are used in the embodiment of FIG. 15A, to support the antenna much like ridges 1420 and 1422. These extensions can have circular, square, or other shapes as appropriate for the desired application. In FIG. 15B, a set of channels 1506 are formed in a wall of housing 102, in which the antenna rests. Again, adhesives, glues, potting compounds and the like can be used to secure the antenna in place, as well as friction. In FIG. 15C, the antenna is simply glued or bonded in place against a surface, while in FIG. 15D, the antenna is secured in place against a wall, support ridge, or even a bracket 1608, using an adhesive layer or strip 1610 like element bonded to one of the strips forming the antenna.

FIGS. 16A, 16B, and 16C illustrate additional wireless devices in which the present invention may be used. An alternative style of wireless phone is shown in FIGS. 16A and 156, while a corner section of a housing for a wireless device used in association with a computer, modem, or similar portable electronic device is shown in FIG. 16C.

In FIGS. 16A and 16B, a phone 1600 is shown having a main housing or body 1602 supporting a whip antenna 1604 and a helical antenna 16506. As before, antenna 1604 is generally mounted to share a common central axis with antenna 1606, so that it extends or protrudes through the center of helical antenna 1606 when extended, although not required for proper operation. These antennas are manufactured with lengths appropriate to the frequency of interest or of use for the particular wireless device on which they are used. Their specific design is well known and understood in the relevant art.

The front of housing 1602 is also shown supporting a speaker 1610, a display panel or screen 1612, a keypad 1614, and a microphone or microphone opening 1616, and a connector 1618. In FIG. 16B antenna 1604 is in an extended position typically encountered during wireless device use, while in FIG. 16A antenna 1604 is shown retracted into housing 1602 (not seen due to viewing angle).

In the cutaway view of FIG. 16C, antenna 400 is secured in place using a combination of ridges 1420, 1422, and extensions 1602 in an upper corner of a wireless device 1630. Cable or conductor set 1632 is used to connect the antenna to appropriate circuitry within the wireless device, such as a portable computer, data terminal, facsimile machine, or the like.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What I claim as my invention is:

1. A dual strip antenna, comprising a first conductive strip having a length selected such that it acts as an active radiator of electromagnetic energy at a first preselected frequency; and a second conductive strip being separated along its length from said first strip by a dielectric material having a prescribed thickness and having a length different from the length of said first strip, said length being selected such that said second strip acts as an active radiator of electromagnetic energy at a second preselected frequency slightly offset from the first, said first strip being electrically connected to said second strip at one end, and both operating as an open-end parallel plate waveguide, with asymmetrical conductor terminations.

2. The dual strip antenna of claim 1, wherein said antenna has a desired center frequency of $f_0$, said first conductive strip length is chosen so that the strip has a center frequency around $f_0$ plus a predetermined frequency offset of $\Delta f$, and said second conductive strip length is chosen so that the strip has a center frequency around $f_0$ minus $\Delta f$.

3. The dual strip antenna of claim 1, wherein said first and second strips are formed by bending a flat sheet of electrically conductive material into a pre-selected shape.

4. The dual strip antenna of claim 1, wherein said first and second strips are formed by depositing metallic material on a dielectric substrate and electrically connecting said metallic strips together at one end.

5. The dual strip antenna of claim 1, wherein said first and second strips are formed by shaping flat conductive material into a U-shape with each arm of the U forming one strip.

6. The dual strip antenna of claim 1, wherein said first and second strips are formed by shaping flat conductive material into a V-shape with each arm of the V forming one strip.

7. The dual strip antenna of claim 1, wherein said first strip is positioned substantially parallel to said second strip.

8. The dual strip antenna of claim 1, wherein said first and second strips flare away from each other near an open end.

9. The dual strip antenna of claim 1, further comprising a coaxial signal feed having positive and negative terminals, the positive terminal being electrically coupled to said first strip and the negative terminal being electrically coupled to said second strip, wherein surface currents are formed on said first and second strips when said dual strip antenna is energized by electrical signals via said coaxial feed.

10. The dual strip antenna of claim 1, further comprising a coaxial feed having positive and negative terminals, the positive terminal being electrically coupled to said second strip and the negative terminal being electrically coupled to said first strip, wherein surface currents are formed on said first and second strips when said dual strip antenna is energized by electrical signals via said coaxial feed.

11. The dual strip antenna of claim 1, in wherein the length of said first strip is longer than the length of the second strip.

12. The dual strip antenna of claim 1, wherein the widths of said first and second strips are unequal.

13. The dual strip antenna of claim 1, wherein the width of said first strip is equal to the width of said second strip.

14. The dual strip antenna of claim 1, wherein said dielectric material is air.

15. The dual strip antenna of claim 1, wherein said dielectric material is foam.

16. The dual strip antenna of claim 1, wherein the length and width of said first and second strips are sized so that said dual strip antenna is capable of receiving and transmitting signals having a frequency range of 1.85–1.99 GHz.

17. The dual strip antenna of claim 1, wherein the length and width of said first and second strips are sized so that said dual strip antenna is capable of receiving and transmitting signals having a frequency range of 824–894 MHz.

18. The dual strip antenna of claim 1, wherein the length and width of said first strip is approximately 1.5 inches and 0.2 inches, respectively, and the length and width of said second strip is approximately 2.1 inches and 0.2 inches, respectively.

19. The dual strip antenna of claim 1, wherein the length and width of said first strip is approximately 2.8 inches and 0.2 inches, respectively, and the length and width of said second strip is approximately 5 inches and 0.4 inches, respectively.

* * * * *